US010595375B2

(12) United States Patent
Lambooij et al.

(10) Patent No.: US 10,595,375 B2
(45) Date of Patent: Mar. 17, 2020

(54) RICH BLACK LIGHTING DEVICE FOR DIFFERENTIATING SHADES OF BLACK

(71) Applicant: SIGNIFY HOLDING B.V., Eindhoven (NL)

(72) Inventors: Marcus Theodorus Maria Lambooij, Eindhoven (NL); Dragan Sekulovski, Eindhoven (NL); Tobias Borra, Rijswijk (NL); Petrus Johannes Hendrikus Seuntiens, Hoogeloon (NL); Martinus Petrus Joseph Peeters, Weert (NL); Lucas Josef Maria Schlangen, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/479,974

(22) PCT Filed: Dec. 21, 2017

(86) PCT No.: PCT/EP2017/084094
§ 371 (c)(1),
(2) Date: Jul. 23, 2019

(87) PCT Pub. No.: WO2018/137867
PCT Pub. Date: Aug. 2, 2018

(65) Prior Publication Data

US 2019/0380178 A1 Dec. 12, 2019

(30) Foreign Application Priority Data

Jan. 26, 2017 (EP) ..... 17153211

(51) Int. Cl.
*H05B 33/08* (2020.01)
*A47F 11/10* (2006.01)

(52) U.S. Cl.
CPC ..... *H05B 33/086* (2013.01); *A47F 11/10* (2013.01); *H05B 33/0872* (2013.01)

(58) Field of Classification Search
None
See application file for complete search history.

(56) References Cited

U.S. PATENT DOCUMENTS

2014/0210368 A1 7/2014 Lee et al.
2016/0223146 A1 8/2016 Vick et al.

FOREIGN PATENT DOCUMENTS

CA 2639897 A1 3/2010
WO 2013088313 A1 12/2012

OTHER PUBLICATIONS https://en.wikipedia.org/wiki/Shades_of black.
http://www.esquire.com/style/mens-fashion/advice/a33035/advice-navy-blue-or-black-032713/.
http://www.dharmatrading.com/techniques/how-to.html.

*Primary Examiner* — Jimmy T Vu
*Assistant Examiner* — Laura Yesildag
(74) *Attorney, Agent, or Firm* — Daniel J. Piotrowski

(57) ABSTRACT

The invention provides a lighting system comprising one or more solid state light sources, wherein the lighting system is configured to provide lighting system light having a correlated color temperature of at least 1700 K and having a S* value of at least 33 in a first setting of the lighting system, wherein the S* value is defined as $S^*=100^*(2^*A^*+B^*)/W_S$ with A* being the spectral power in the wavelength range of 380-440 nm, B* being the spectral power in the wavelength range of 660-780 nm, and $W_s$ being the total spectral power in the wavelength range of 380-780 nm of the lighting system light.

14 Claims, 2 Drawing Sheets

RICH BLACK LIGHTING DEVICE FOR DIFFERENTIATING SHADES OF BLACK

CROSS-REFERENCE TO PRIOR APPLICATIONS

This application is the U.S. National Phase application under 35 U.S.C. § 371 of International Application No. PCT/EP2017/084094, filed on Dec. 21, 2017, which claims the benefit of European Patent Application No. 17153211.2, filed on Jan. 26, 2017. These applications are hereby incorporated by reference herein.

FIELD OF THE INVENTION

The invention relates to a lighting system, its use, as well as a method of lighting (with such lighting system).

BACKGROUND OF THE INVENTION

Lighting devices for having specific lighting properties are known in the art. US2016223146, for instance, describes light sources that emit light having enhanced color spectrum characteristics. A color metric called the Lighting Preference Index (LPI) is described that enables quantitative optimization of color preference by tailoring the spectral power distribution of the light source. A lamp includes at least one blue light source having peak wavelength in the range of about 400 nanometer (nm) to about 460 nm, at least one green or yellow-green light source having peak wavelength in the range of about 500 nm to about 580 nm, and at least one red light source having peak wavelength in the range of about 600 nm to about 680 nm, wherein the lamp has an LPI of at least 120. The formula for LPI is based on an observer set within the age range of 21 to 27 years, with a gender distribution of 58% male and 42% female, a race distribution of 92% Caucasian and 8% Asian, and a geographical distribution within North America.

SUMMARY OF THE INVENTION

Brand identity is a key differentiating theme in retail business for retailers to distinguish themselves from competition. Lighting can assist in providing an ambient color that fits their brand identity, e.g. cool or warm atmosphere. Equally important to brand identity is proper textile enhancement, which can be achieved with specific lighting systems. However, also such specific lighting system do not have proper black rendering.

Hence, it is an aspect to provide an alternative lighting system or method of illuminating (retail) products, which preferably further at least partly obviates one or more of above-described drawbacks. Hence, the present invention may have as object to overcome or ameliorate at least one of the disadvantages of the prior art, or to provide a useful alternative.

Hundreds of (solid state based) lighting solutions were investigated, but none of them appeared to have a sufficient black rendering. Hence, a new lighting solution was created which provided a good black rendering, allowing distinguishing different shades of black. It turned out that good black rendering could be obtained when there is a minimum power in the flanks of the visible, especially between 380 nm and 440 nm and between 660 nm and 780 nm.

Therefore, in an aspect a lighting system is provided, which lighting system ("system") comprises one or more light sources, especially one or more solid state light sources, wherein the lighting system is configured to provide lighting system light ("light") especially having a correlated color temperature (CCT, herein also indicated as "color temperature") of at least 1700 K, and having a S* value of at least 33 in a first setting of the lighting system, wherein the S* value is defined as $S^*=100^*(2^*A^*+B^*)/W_S$, with A* being the spectral power in the wavelength range of 380-440 nm, B* being the spectral power in the wavelength range of 660-780 nm, and $W_s$ being the total spectral power in the wavelength range of 380-780 nm of the lighting system light (in said first setting).

It appears that with such lighting system and with light with such S* value different shades of black can well be distinguished. The black discrimination index (BDI), which is a measure therefore is relatively high for light with an S* value equal to or larger than 33, such as equal to or larger than 35. The black discrimination index is defined as the average color differences between black reflection spectra in the CIECAM02 color space. Amongst others, also based on user tests, with trained users, it appears that an S* value of lower than about 33 does not allow sufficiently distinguishing different shades of black, whereas at values of about 33 and larger distinguishing different shades of black is well possible. Especially, the lighting system is configured to provide lighting system light having an S* value of at least 35 in the first setting. Further, especially the S* value is not larger than 85, such as not larger than about 75, such as in the range of 35-75, like 40-65. Further, even though black shades may be well displayed, the light may still appear as white light with a color point relatively close (or on) the black body locus (BBL). Especially, the lighting system may be used for retail lighting.

The phrase "in a first setting of the lighting system" indicates that the lighting system at least has the functionality of being switched on and providing this light with this S* value. However, in further embodiments the lighting system may be controllable and have more than one setting (including this first setting); see further also below.

In a specific embodiment, the color temperature is at least 2000 K. For applications in retail or other applications, such as in offices, etc., the color temperature is at least 2700 K, such as at least 3000 K. Hence, in embodiments the lighting system is configured to provide lighting system light having a correlated color temperature of at least 2700 K in the first setting. In general, the color temperature is not larger than 7000 K, such as not larger than 6500 K. The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

In yet further embodiments, the black rendering is not only sufficient, or good, or excellent, but also the rendering of other colors is at least sufficient or good. Hence, in embodiments the lighting system is configured to provide lighting system light having a color rendering index of at least 80 in the first setting, such as at least 85, like at least 90.

The lighting system comprises one or more light sources, especially one or more solid state light sources. The light source is a light source that during operation emits (light source light). The light source light may be used per se for providing the lighting system light or may at least partly converted by a luminescent material (see also below). The light of the light sources, optionally after at least partial conversion by a luminescent material, especially provides the lighting system light. In a specific embodiment, the light source(s) comprises solid state light source(s) (such as a LED or laser diode). The term "light source" may also relate to a plurality of light sources, such as 2-2000 (solid state) LED light sources. Hence, the term LED may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module.

As also indicated above, the light of the lighting system may be provided in different ways. For instance, a plurality of solid state light sources may be used to provide the desired spectral distribution. Further, optionally a luminescent material, optically pumped by one or more light sources, may be used to provide one or more parts of the spectral distribution.

In specific embodiments, the lighting system comprising one or more solid state light sources having a peak wavelength selected from the range of 380-440 nm. Such light source(s) may in embodiments be used for pumping a luminescent material, whereby at least part of the light of the solid state light sources is not used, and can provide the A* part of the spectral distribution. The term "peak wavelength" may refer to spectral line or wavelength having the greatest power.

However, in yet other embodiments such light source(s) may essentially not be used for pumping a luminescent material and the light of such light sources is essentially entirely used for the A* part of the spectral distribution. In the latter embodiments, one or more further light sources should be provided for providing the remainder of the spectral distribution in the visible. In such embodiments, the peak wavelength selected from the range of 380-440, such as from the range of 380-410 nm. Light sources which have peak wavelengths in the range of 380-410 nm may especially be used for pumping a luminescent material and/or for providing spectral distribution in the A* part of the spectral distribution. The phrase "pumping a luminescent material" and similar terms (like "optically pumping") may refer to providing light to such material for conversion by such luminescent material into luminescent material light. An alternative phrase may be "exciting a luminescent material".

Hence, in embodiments the lighting system comprises one or more (solid state) light sources having a peak wavelength selected from the range of 400-440 nm. Such light sources may be used for providing blue light, and/or for pumping a luminescent material and/or for providing spectral distribution in the A* part of the spectral distribution.

Therefore, in specific embodiments the lighting system comprises one or more first (solid state) light sources having a first peak wavelength selected from the range of 380-440 nm and one or more second (solid state) light sources having a second peak wavelength selected from the range of 430-490 nm, wherein peak lengths of the one or more first light sources and the one or more second light sources differ at least 15 nm. In addition, the lighting system may comprise a luminescent material and/or further light sources for providing the remainder of the spectral distribution (especially for providing white light).

In specific embodiments, the B* part may be provided with the luminescence of a luminescent material. The term "luminescent material" herein may in embodiments also refer to a plurality of different luminescent materials (with luminescences having different spectral distributions). Red luminescent materials, or deep red luminescent materials, are known in the art.

Hence, in an embodiment the luminescent material comprises a red luminescent material selected from the group consisting of Mn(IV) luminescent materials, even more especially the luminescent material comprises a luminescent material of the type $M_2AX_6$ doped with tetravalent manganese, wherein M comprises an alkaline cation, wherein A comprises a tetravalent cation, and wherein X comprises a monovalent anion, at least comprising fluorine (F). For instance, $M_2AX_6$ may comprise $K_{1.5}Rb_{0.5}AX_6$. M relates to monovalent cations, such as selected from the group consisting of potassium (K), rubidium (Rb), lithium (Li), sodium (Na), cesium (Cs) and ammonium ($NH_4^+$), and especially M comprises at least one or more of K and Rb. Preferably, at least 80%, even more preferably at least 90%, such as 95% of M consists of potassium and/or rubidium. The cation A may comprise one or more of silicon (Si) titanium (Ti), germanium (Ge), stannum (Sn) and zinc (Zn). Preferably, at least 80%, even more preferably at least 90%, such as at least 95% of M consists of silicon and/or titanium. Especially, M comprises potassium and A comprises titanium. X relates to a monovalent anion, but especially at least comprises fluorine. Other monovalent anions that may optionally be present may be selected from the group consisting of chlorine (Cl), bromine (Br), and iodine (I). Preferably, at least 80%, even more preferably at least 90%, such as 95% of X consists of fluorine. The term "tetravalent manganese" refers to $Mn^{4+}$. This is a well-known luminescent ion. In the formula as indicated above, part of the tetravalent cation A (such as Si) is being replaced by manganese. Hence, $M_2AX_6$ doped with tetravalent manganese may also be indicated as $M_2A_{1-m}Mn_mX_6$. The mole percentage of manganese, i.e. the percentage it replaces the tetravalent cation A will in general be in the range of 0.1-15%, especially 1-12%, i.e. m is in the range of 0.001-0.15, especially in the range of 0.01-0.12. Further embodiments may be derived from WO2013/088313, which is herein incorporated by reference.

However, manganese oxide compounds, such as Mn(IV) comprising compounds may also show broad band emissions which may be used as well or even better.

For instance, the luminescent material may (now) include a red luminescent material. In a further specific embodiment, the luminescent material comprises one or more luminescent materials selected from the group consisting of divalent europium containing nitride luminescent material or a divalent europium containing oxynitride luminescent material. The luminescent material may in an embodiment comprise one or more materials selected from the group consisting of (Ba,Sr,Ca)S:Eu, (Ba,Sr,Ca)$AlSiN_3$:Eu and $(Ba,Sr,Ca)_2Si_5N_8$:Eu. In these compounds, europium (Eu) is substantially or only divalent, and replaces one or more of the indicated divalent cations. In general, Eu will not be present in amounts larger than 10% of the cation, especially in the range of about 0.5-10%, more especially in the range of about 0.5-5% relative to the cation(s) it replaces. The term ":Eu" or ":$Eu^{2+}$", indicates that part of the metal ions is replaced by Eu (in these examples by $Eu^{2+}$). The material (Ba,Sr,Ca)S:Eu can also be indicated as MS:Eu, wherein M is one or more elements selected from the group consisting of barium (Ba), strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca). Further, the material $(Ba_5Sr_5Ca)_2Si_5N_8$:Eucan also be indicated as $M_2Si_5N_8$:Eu, wherein M is one or more elements selected from the group consisting of barium (Ba), strontium (Sr) and calcium (Ca). Here, Eu is introduced and replaces at least part of M i.e. one or more of Ba, Sr, and Ca). Likewise, the material $(Ba_5Sr_5Ca)$ $AlSiN_3$:Eu can also be indicated as $MAlSiN_3Eu_5$ wherein M is one or more elements selected from the group consisting of barium $(Ba)_5$ strontium (Sr) and calcium (Ca); especially, M comprises in this compound calcium or strontium, or calcium and strontium, more especially calcium. Here, Eu is introduced and replaces at least part of M (i.e. one or more of Ba, Sr, and Ca). Especially, the luminescent material comprises (Ca,Sr,Ba)$AlSiN_3$:Eu, preferably $CaAlSiN_3$:Eu. Further, in another embodiment, which may be combined with the former, the luminescent material comprises $(Ca,Sr,Ba)_2Si_5N_8$:Eu, preferably $(Sr,Ba)_2Si_5N_8$:Eu. The terms "(Ca,Sr,Ba)" indicate that the corresponding cation may be occupied by calcium, strontium or barium. It also indicates that in such material corresponding cation sites may be occupied with cations selected from the group consisting of calcium, strontium and barium. Thus, the material may for instance comprise calcium and strontium, or only strontium, etc. Hence, in an embodiment the luminescent material may further comprises $M_2Si_5N_8:Eu^{2+}$, wherein M is selected from the group consisting of Ca, Sr and Ba, even more especially wherein M is selected from the group consisting of Sr and Ba. In yet another embodiment, which may be combined with the former, the luminescent material may further comprise $MAlN_3:Eu^{2+}$, wherein M is selected from the group consisting of Ca, Sr and Ba, even more especially wherein M is selected from the group consisting of Sr and Ba.

However, also other red luminescent materials may be applied, like quantum dots. Especially, broad band emitters may be applied, which, upon excitation in the UV or blue may emit in at least the red part of the visible spectrum, and which may in embodiments have at least 10%, such as at least 20%, like at least 30%, even more especially at least 40% of their emission in the visible in the spectral range of 660-780 nm.

Yet further, alternatively or additionally the B* part of the spectrum may also be provided directly with a (solid state) light source. Therefore, in embodiments the lighting system comprises one or more (solid state) light sources having a peak wavelength selected from the range of 380-440 nm.

Therefore, in specific embodiments the lighting system comprises one or more first solid state light sources having a first peak wavelength selected from the range of 380-440 nm, one or more second solid state light sources configured to provide white light source light, and one or more third solid state light sources having a peak wavelength selected from the range of 660-780 nm.

In specific embodiments, the A* part may (also) be provided with the luminescence of a luminescent material. As indicated above, the term "luminescent material" herein may in embodiments also refer to a plurality of different luminescent materials (with luminescences having different spectral distributions).

The lighting system light may essentially comprise the light of the one or more (different) light sources (providing light source light) and, where applicable, luminescent material light of one or more luminescent materials pumped with light from one or more of the one or more (different) light sources.

The lighting system may provide light with an essentially fixed spectral distribution. However, in further embodiments one or more lighting properties, including a spectral power distribution, of the lighting system light are controllable. When one or more lighting properties are controllable, the lighting system may allow the first setting but also one or more further settings. In such further settings, the light of the lighting system may also have an S* value over 33 and a color temperature of at least 1700 K, but this is not necessarily the case. Likewise, the S* value in other settings may also be larger than 75. The latter embodiment may e.g. be used for additional lighting in situations where available light already has a relatively high S* value, such as daylight in a shop where at least part of the light in the shop is provided by daylight. Settings may be changed with user interfaces. Examples of user interface devices include a manually actuated button, a display, a touch screen, a keypad, a voice activated input device, an audio output, an indicator (e.g., lights), a switch, a knob, a modem, and a networking card, among others. Especially, the user interface device may be configured to allow a user instruct the device or apparatus with which the user interface is functionally coupled by with the user interface is functionally comprised. The user interface may especially include a manually actuated button, a touch screen, a keypad, a voice activated input device, a switch, a knob, etc., and/or optionally a modem, and a networking card, etc. The user interface may comprise a graphical user interface. Hence, the system may include e.g. buttons, switches, etc. The term "user interface" may also refer to a remote user interface, such as a remote control. A remote control may be a separate dedicate device. However, a remote control may also be a device with an App configured to (at least) control the lighting system. Alternatively or additionally, settings may be changes in dependence of a sensor signal (see also below), a timer, etc. etc.

Therefore, in embodiments the lighting system further comprises a control system adapted to provide at least a controlling mode which comprises maintaining a predetermined S* value of the lighting system light while allowing another lighting property of the lighting system light to be changed from a first lighting property value to a second lighting property value. In specific embodiments, the other lighting property is selected from the group consisting of correlated color temperature, color point, and intensity of the lighting system light. Hence, e.g. a user may change the color point or color temperature, while the system maintains the S* value at a predetermined value. In a specific controlling mode, this predetermined S* value may be at least 33, whereas in one or more (optional) further modes the S* value may have a lower or higher value. Further, the lighting system may also include one or more other controlling modes wherein one or more other lighting property values may be maintained, and one or more yet other lighting properties may be changed. The control system may comprise or be functionally coupled to the user interface.

In specific embodiments, the control system is further adapted to provide a controlling mode which comprises maintaining the predetermined S* value of the light system light as function of a (light sensor signal of a) light sensor configured to sense one or more of ambient light and reflected light.

As will be clear from the above, the predetermined S* value may in embodiments be a fixed value, but may in other embodiments be a variable value, e.g. variable based on a ((day)light) sensor, a time scheme, user interface input, etc.

As indicated above, the control system may be adapted to provide at least a controlling mode which comprises maintaining a predetermined S* value of the light while allowing another lighting property of the light to be changed from a first lighting property value to a second lighting property value. This does not exclude that the control system may further be adapted for providing another controlling mode, or a plurality of other controlling modes. For instance, in embodiments the control system may also be adapted to provide a controlling mode wherein essentially all lighting properties may be freely variable, or wherein another lighting property is fixed, and one or more other, including the S* value, may be variable. However, the control system is adapted to provide at least a controlling mode which comprises maintaining a predetermined S* value of the light while allowing another lighting property of the light to be changed from a first lighting property value to a second lighting property value. Would other modes be available, the choice of such modes may especially be executed via a user interface, though other options, like executing a mode in dependence of a sensor signal or a (time) scheme may also be possible. For instance, the control system may be in the controlling mode as defined herein from sunset to sunrise, allowing the user other lighting choices during the day, etc. The term "controlling" and similar terms especially refer at least to determining the behavior or supervising the running of an element. Hence, herein "controlling" and similar terms may e.g. refer to imposing behavior to the element (determining the behavior or supervising the running of an element), etc., such as e.g. measuring, displaying, actuating, opening, shifting, changing temperature, etc. Beyond that, the term "controlling" and similar terms may additionally include monitoring. Hence, the term "controlling" and similar terms may include imposing behavior on an element and also imposing behavior on an element and monitoring the element. Of course, the lighting properties can be controlled within the technical boundaries that the system, such as the lighting device, provides (like maximum power, etc.).

The phrase "control system is adapted to provide at least a controlling mode which comprises maintaining a predetermined S* value of the light while allowing another lighting property of the light to be changed from a first lighting property value to a second lighting property value" especially indicates that the S* value is at a fixed value, while one or more other lighting properties may be varied (e.g. in dependence of one or more of a sensor signal, a (time) scheme, and a user input (value or instruction)).

For the one or more other lighting properties may also apply that these may be controlled with the control system. Hence, the control system may control based on the input of a sensor, such as a (day)light sensor, or may control based on a predefined (time) scheme, etc., one or more of the other lighting properties. Alternatively or additionally, one or more other lighting properties may be selected by a user (via a user interface). Hence, controlling a lighting property may include controlling such lighting property in dependence of one or more of a sensor signal, a (time) scheme, and a user input (value or instruction).

The phrase "maintaining a predetermined S* value of the light" especially indicates that the S* value is essentially the same at the first lighting property value and the second lighting property value. Here, the terms "maintaining" and "essentially the same", may especially refer to a change in value of the S* value of equal to or less than 20%, such as equal to or less than 10%. Hence, the word "maintaining" and similar terms may also refer to "substantially maintaining", or maintaining with some tolerance, which, as indicated above, may e.g. be in the range of about ±20%, such as about ±10%, like especially about ±5%.

Hence, the phrase "in a first setting of the lighting system" may in embodiments, wherein the light is controllable, also be interpreted as "in a first setting of the lighting system and optionally in one or more other settings".

In a further aspect, the invention provides a method of controlling lighting system light of a lighting system (such as defined herein), the lighting system comprising one or more light sources, especially solid state light sources, wherein one or more lighting properties, including the spectral power distribution, of the lighting system light are controllable, the method comprising maintaining a predetermined S* value of the lighting system light while changing another lighting property of the lighting system light from a first lighting property value to a second lighting property value, wherein the S* value is defined as $S^*=100^*(2^*A^*+B^*)/W_S$, with A* being the spectral power in the wavelength range of 380-440 nm, B* being the spectral power in the wavelength range of 660-780 nm, and $W_s$ being the total spectral power in the wavelength range of 380-780 nm of the lighting system light. Especially, the method of controlling lighting system light of a lighting system is used to control the lighting system light of the lighting system as defined herein.

In yet a further aspect, the invention also provides a computer program product, when running on a computer which is functionally coupled to a lighting system, especially a lighting system as described herein, is capable of bringing about the method as described herein, wherein the lighting system is configured to provide lighting system light, wherein one or more lighting properties, including the spectral power distribution, of the lighting system light are controllable.

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, (outdoor) road lighting systems, urban lighting systems, green house lighting systems, horticulture lighting, etc.

The terms "violet light" or "violet emission" especially relates to light having a wavelength in the range of about 380-440 nm. The terms "blue light" or "blue emission" especially relates to light having a wavelength in the range of about 440-495 nm (including some violet and cyan hues). The terms "green light" or "green emission" especially relate to light having a wavelength in the range of about 495-570 nm. The terms "yellow light" or "yellow emission" especially relate to light having a wavelength in the range of about 570-590 nm. The terms "orange light" or "orange emission" especially relate to light having a wavelength in the range of about 590-620 nm. The terms "red light" or "red emission" especially relate to light having a wavelength in the range of about 620-780 nm. The term "pink light" or "pink emission" refers to light having a blue and a red component. The terms "visible", "visible light" or "visible emission" refer to light having a wavelength in the range of about 380-780 nm.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Current LED solutions appear to be unable to reveal the small color differences that black textiles actually have. This of course is an undesired effect of LED solutions for the consumer, but also for the store and fashion designers whose items are not displayed to their full extent. Additionally, creating true black fabrics brings additional costs which is currently not visible to the consumer as the differences with dark blue/red/brown are not distinguishable anyways. Hence, the consequences are that retailers are not able to sell more expensive black materials (and thus sell cheaper off-black colors). Designers are less reluctant to cooperate with retailers that cannot sell their designs and consumers are not satisfied since their black items appears to be of-black in day-light or under a different illuminant.

Figure 1:
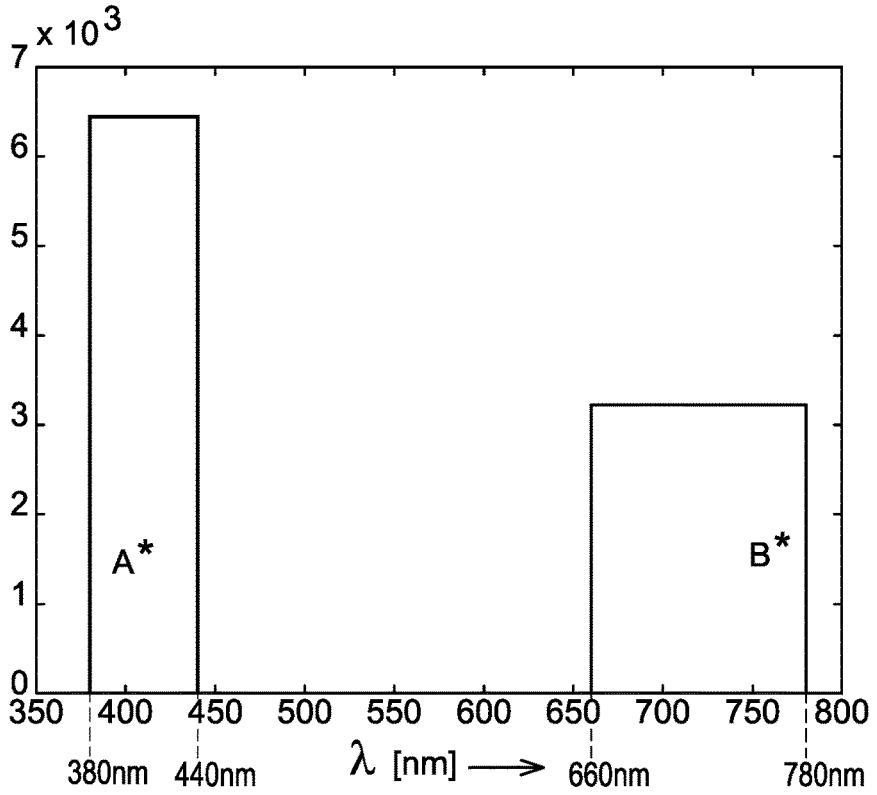
FIG. 1 schematically shows the definition of S*, A* and B*, with S*=100*((380≤power≤440)*2+(780≥power≥660))/total power (not luminance)≥33 (or, when multiplied with 100%, it can be indicated in %.

To overcome this issue we define black discrimination index (BDI) and S*. BDI is defined as the average color differences between black reflection spectra in the CIA-CAM02 color space of the spectra enclosed. S* is defined as 100*(2*A*+B*)/total power*100 with A* is power between 380 nm and 440 nm and B* is power between 660 nm and 780 nm, see also FIG. 1.

Figure 2:
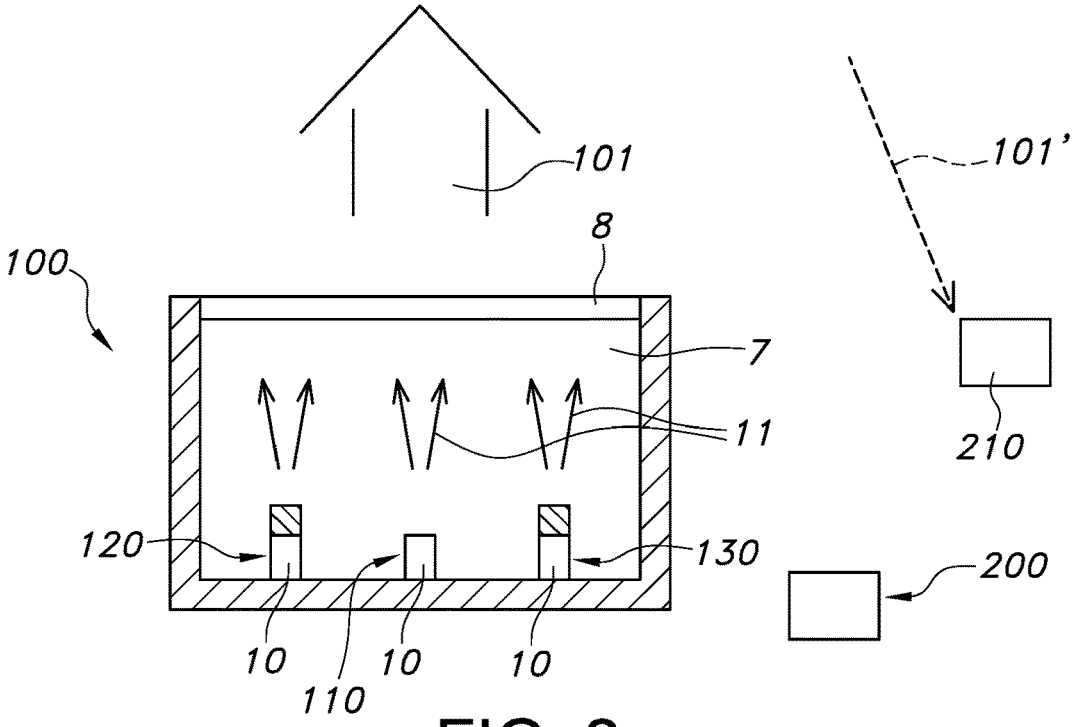
FIG. 2 schematically depicts a possible embodiment.

FIG. 2 schematically depicts an embodiment of a lighting system 100 comprising one or more light sources, especially solid state light sources 10, wherein the lighting system 100 is configured to provide lighting system light 101 as further defined herein.

For instance, the lighting system 100 comprises one or more first solid state light sources 110 having a first peak wavelength selected from the range of 380-440 nm and one or more second solid state light sources 120 having a second peak wavelength selected from the range of 430-490 nm, wherein peak lengths of the one or more first light sources 110 and the one or more second light sources 120 differ at least 15 nm.

Alternatively or additionally, the lighting system 100 comprises one or more solid state light sources 10 having a peak wavelength selected from the range of 660-780 nm.

FIG. 2 may e.g. schematically depict an embodiment wherein the lighting system 100 comprises one or more first solid state light sources 110 having a first peak wavelength selected from the range of 380-440 nm, one or more second solid state light sources 120 configured to provide white light source light 11, and one or more third solid state light sources 130 having a peak wavelength selected from the range of 660-780 nm.

One or more lighting properties, including a spectral power distribution, of the lighting system light 101 may especially be controllable. Hence, in a variant the lighting system 100 comprises a control system 200. For instance, the control system 200 may be adapted to provide a controlling mode which comprises maintaining the predetermined S* value of the light system light 101 as function of a light sensor 210, e.g. configured to sense one or more of ambient light 1 and reflected light 101'. Here, a variant is depicted wherein e.g. reflected light 101' reflected at a remote object (not depicted) may be measured. In dependence thereof, the S* value may be increased or decreased and/or other lighting parameters may be varied. The control system 200 may include or may be functionally coupled to a user interface.

In use, a predetermined S* value of the lighting system light 101 may be maintained while changing another lighting property of the lighting system light 101 from a first lighting property value to a second lighting property value, wherein the S* value is defined as $S^*=100^*(2^*A^*+B^*)/W_S$, with A being the spectral power in the wavelength range of 380-440 nm, B being the spectral power in the wavelength range of 660-780 nm, and $W_s$ being the total spectral power in the wavelength range of 380-780 nm of the lighting system light 101.

FIG. 2 schematically depicts an embodiment with a cavity 7 (or "light mixing chamber") and a light transmissive window 8, e.g. of glass, polymer, or other light transmissive (solid) material, configured downstream of the one or more light sources 10. The window 8 is configured downstream of the light sources 10.

The terms "upstream" and "downstream" relate to an arrangement of items or features relative to the propagation of the light from a light generating means (here the especially the light source), wherein relative to a first position within a beam of light from the light generating means, a second position in the beam of light closer to the light generating means is "upstream", and a third position within the beam of light further away from the light generating means is "downstream".

As shown in FIG. 2, the lighting system light 101, here downstream of the window 8, may essentially comprise the light of the one or more (different) light sources 10 (providing light source light) and, where applicable, luminescent material light of one or more luminescent materials pumped with light from one or more of the one or more (different) light sources 10.

Examples of lighting systems may e.g. include:

- In an embodiment, the light source comprises of a blue pumped white LED source with a violet led (peak wavelength≤440 nm and ≥380 nm), in combination with a deep red phosphor;
- In an alternative embodiment, the light source comprises of a blue pumped white LED source and additionally a deep red led (peak wavelength ≥660 nm and ≤780 nm) and a violet led (peak wavelength ≤440 nm and ≥380 nm);
- In an alternative embodiment, the light source comprises of a blue pumped white LED source and additionally a deep red led (peak wavelength ≥660 nm and ≤780 nm;
- In an alternative embodiment, the light source is a violet pumped white LED covered with a phosphor layer that includes phosphors with emission spectrum that includes wavelengths equal to or above 660 nm. Examples of phosphors are (oxy)nitride red phosphors $(Mg,Sr,Ca)AlSiN_3$:Eu and $(Ba,Sr,Ca)_2Si_{5-x}Al_xO_xN_{8-x}$:Eu;
- In an alternative embodiment, the light source comprises of 2 blue LEDs (peaks at 410 and 450 nm), green phosphor (LuAG) and a red phosphor (mixture of e.g. two different red nitrides. The resulting spectrum has a S of 40;
- In an alternative embodiment, the light source comprises of 2 blue LEDs (peaks at 410 and 450 nm), green phosphor (LuAG) and a red phosphor (mixture of two different red nitrides). The resulting spectrum has a S of 40;

In an alternative embodiment, the light source is a blue pumped white LED covered with a phosphor layer that includes phosphors with emission spectrum that includes wavelengths above 650 nm;

In the preferred embodiment, the light source has a CCT of between 1700 K and 6500 K;

In the preferred embodiment, the light source has CRI≥70 and a gamut area index (GAI)≥80.

In embodiments, the invention also provides a lighting system (or light emitting apparatus) that comprises at least one light source, and at least one (programmed) control system, where the control system is configured to vary the spectral composition of the light output of the system, in such a way that S* (defined as (2*A*+B*)/total power*100 with A* is power between 380 nm and 440 nm and B* is power between 660 nm and 780 nm), CRI and total light output is kept constant by the control system (or changes less than 10%), while correlated color temperature (CCT) generated by the system (or experienced by the user) is varied.

In an embodiment, the user adjusts the CCT of the light system to a target setting. This may be for instance a higher CCT to mimic office lighting, or a low CCT to mimic evening lighting. The BDI, CRI and total light output of the system will then be kept constant, resulting in a light system that switches between higher and lower CCT, while keeping other relevant metrics constant.

In an embodiment, the system adjusts the CCT of the light system to a target setting, e.g. either before sunrise or after sunset, to enable optimal discrimination of (black) colors during periods when natural daylight is less available. Again, other relevant metrics like, CRI and total light output will be kept constant.

In an example, a retail store where it is desirable to be able to 'switch' between the CCT of a more 'regular' lighting solution and a higher CCT, to mimic various lighting conditions (e.g. office, home, retail, etc.).

In an example, a retail store where the CCT of the Rich Black system is optimally adjusted to the CCT of the time of day, thereby allowing optimal comparison and predictions of BDI for specific times of day.

A multitude of potential application areas can be identified for the current invention. In essence, all areas where there exists a need to be able to identify various shades of black are potential application areas, e.g.:

Retail (especially the more "luxurious" lines, where more deeply saturated reds and blues are used to create blacks)

Tailors

Print proofing

Quality control

Interior design

Additionally, the invention may be applicable in situations where a high color fidelity (as compared to daylight) is wanted.

Figure 3:
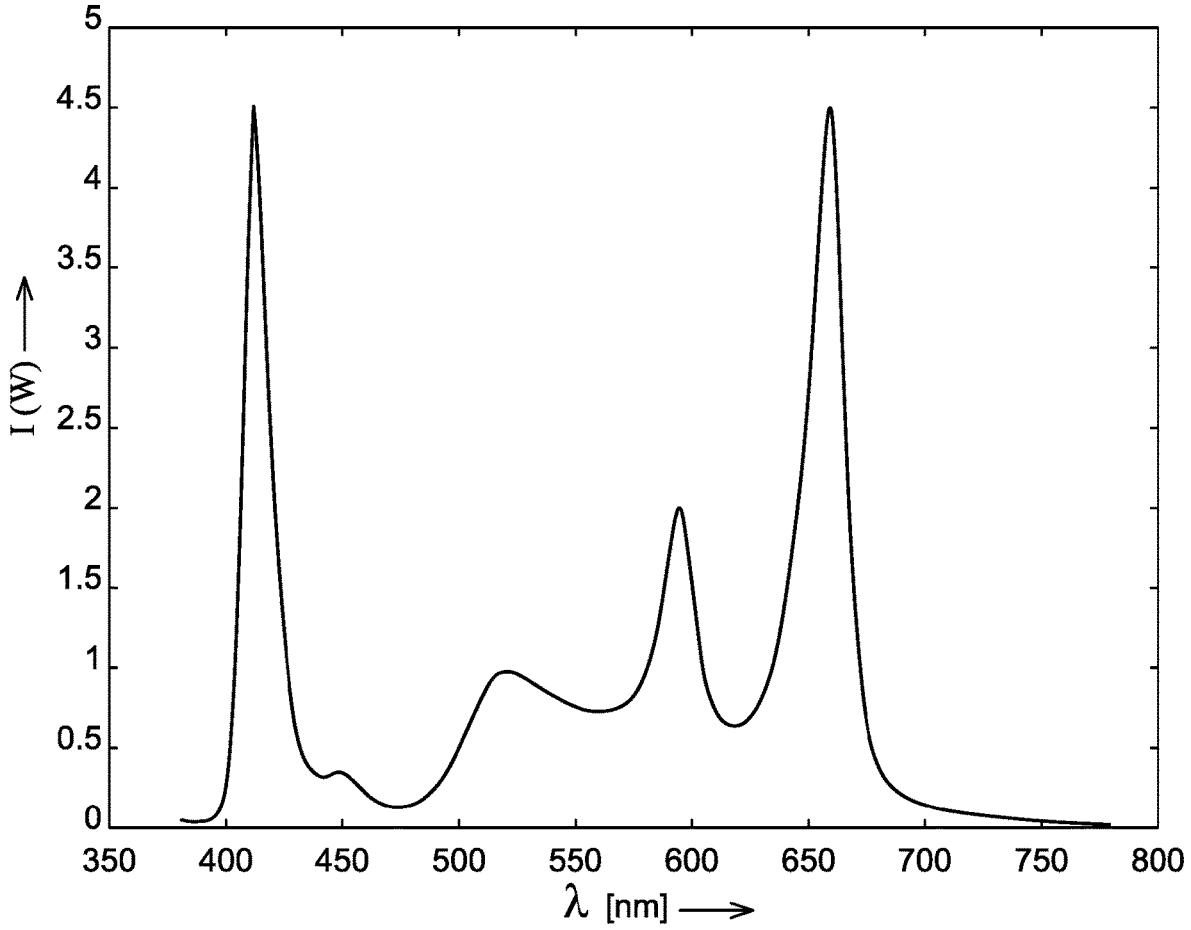
FIG. 3 shows a spectral distribution with a high S* value.

FIG. 3 shows an example of a suitable spectrum, having a S* value of 46. With such spectral distribution the BDI is large and members of a trained panel can better distinguishes different shades of black, than with values below about 33.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements.

The invention claimed is:

1. A lighting system comprising:

one or more solid state sources wherein the lighting system is configured to provide lighting system light having a correlated color temperature of at least 1700 K and having a S* value of at least 33 in a first setting of the lighting system, wherein the S* value representing a black discrimination index is defined as $$S^*=100^*(2^*A^*+B^*)/W_s$$

with A* being the spectral power in the wavelength range of 380-440 nm, B* being the spectral power in the wavelength range of 660-780 nm, and $W_s$ being the total spectral power in the wavelength range of 380-780 nm of the lighting system light.

2. The lighting system according to claim 1, wherein the lighting system is configured to provide lighting system light having a correlated color temperature of at least 2700 K in the first setting.

3. The lighting system according to claim 1, wherein the lighting system is configured to provide lighting system light having a color rendering index of at least 80 in the first setting.

4. The lighting system according to claim 1, wherein the lighting system is configured to provide lighting system light having an S* value of at least 35 in the first setting.

5. The lighting system according to claim 1, wherein the lighting system comprising one or more solid state light sources having a peak wavelength selected from the range of 380-440 nm.

6. The lighting system according to claim 1, wherein the lighting system comprises one or more solid state light sources having a peak wavelength selected from the range of 400-440 nm.

7. The lighting system according to claim 1, wherein the lighting system comprises one or more first solid state light sources having a first peak wavelength selected from the range of 380-440 nm and one or more second solid state light sources having a second peak wavelength selected from the range of 430-490 nm, wherein peak lengths of the one or more first light sources and the one or more second light sources differ at least 15 nm.

8. The lighting system according to claim 1, wherein the lighting system comprises one or more solid state light sources having a peak wavelength selected from the range of 660-780 nm.

9. The lighting system according to claim 1, wherein the lighting system comprises one or more first solid state light sources having a first peak wavelength selected from the range of 380-440 nm, one or more second solid state light sources configured to provide white light source light, and one or more third solid state light sources (130) having a peak wavelength selected from the range of 660-780 nm.

10. The lighting system according to claim 1, wherein one or more lighting properties, including a spectral power distribution, of the lighting system light are controllable.

11. The lighting system according to claim 10, wherein the lighting system further comprises a control system adapted to provide at least a controlling mode which comprises maintaining a predetermined S* value of the lighting system light while allowing another lighting property of the lighting system light to be changed from a first lighting property value to a second lighting property value.

12. The lighting system according to claim 11, wherein the other lighting property is selected from the group consisting of correlated color temperature, color point, and intensity of the lighting system light.

13. The lighting system according to claim 11, wherein the control system is further adapted to provide a controlling mode which comprises maintaining the predetermined S* value of the light system light as function of a light sensor configured to sense one or more of ambient light and reflected light.

14. A method of controlling lighting system light of a lighting system comprising:

one or more solid state sources, wherein one or more lighting properties, including the spectral power distribution of the lighting system light are controllable, and the method comprising maintaining a predetermined S* value of the lighting system light having a correlated color temperature of at least 1700 K while changing another lighting property of the lighting system light from a first lighting property value to a second lighting property value, wherein the S* value being at least 33 representing a black discrimination index is defined as $$S^*=100^*(2^*A^*+B^*)/W_s$$

with A* being the spectral power in the wavelength range of 380-440 nm, B* being the spectral power in the wavelength range of 660-780 nm, and $W_s$ being the total spectral power in the wavelength range of 380-780 nm of the lighting system light.

* * * * *